US006983679B2

(12) United States Patent
Dittrich et al.

(10) Patent No.: US 6,983,679 B2
(45) Date of Patent: Jan. 10, 2006

(54) PROPELLANT MAGAZINE FOR A PROPELLANT-OPERATED SETTING TOOL AND A PROPELLANT-OPERATED SETTING TOOL

(75) Inventors: Tilo Dittrich, Feldkirch (AT); Mario Grazioli, Chur (CH); Thomas Sperrfechter, Zizers (CH); Mario Scalet, Schaan (LI); Gerhard Ehmig, Rankweil (AT)

(73) Assignee: Hilti Aktiengesellschaft, Schaan (LI)

( * ) Notice: Subject to any disclaimer, the term of this patent is extended or adjusted under 35 U.S.C. 154(b) by 394 days.

(21) Appl. No.: 10/241,869

(22) Filed: Sep. 10, 2002

(65) Prior Publication Data

US 2003/0047064 A1 Mar. 13, 2003

(30) Foreign Application Priority Data

Sep. 11, 2001 (DE) ..... 101 44 618

(51) Int. Cl.
*F42B 39/08* (2006.01)

(52) U.S. Cl. ..... 89/35.01; 102/531; 102/281

(58) Field of Classification Search ..... 89/35.01; 102/531, 281

See application file for complete search history.

(56) References Cited

U.S. PATENT DOCUMENTS

| | | | | |
|---|---|---|---|---|
| 3,625,153 | A * | 12/1971 | Gawlick et al. | 102/531 |
| 3,625,154 | A * | 12/1971 | Gawlick et al. | 102/531 |
| 4,026,212 | A * | 5/1977 | Dardick | 102/531 |
| 4,402,268 | A * | 9/1983 | Usel | 102/202.5 |
| 4,819,562 | A * | 4/1989 | Bowman | 102/281 |
| 4,994,125 | A * | 2/1991 | Mei | 149/22 |
| 5,208,420 | A * | 5/1993 | Hamilton et al. | 102/281 |
| 6,474,212 | B1 * | 11/2002 | Grazioli et al. | 89/35.01 |

FOREIGN PATENT DOCUMENTS

WO 9948842 9/1999

* cited by examiner

*Primary Examiner*—M. Clement
(74) *Attorney, Agent, or Firm*—Abelman, Frayne & Schwab

(57) ABSTRACT

A propellant magazine for a propellant-operated setting tool and including a pocket foil (1, 11, 21) having a plurality of recessed, spaced from each other, pockets (2, 12, 22, 42) for receiving each a propellant (3, 13, 23), a cover foil (5, 15, 25) unreleasably connected with the pocket foil (1, 11, 21) for closing the pockets (2, 12, 22), and an electrically conducting strip (7, 17, 27, 37) associated with each pocket (2, 12, 22, 42) and having at least one contact point (8, 9, 18, 19, 28, 29, 31, 32, 38, 39).

16 Claims, 5 Drawing Sheets

PROPELLANT MAGAZINE FOR A PROPELLANT-OPERATED SETTING TOOL AND A PROPELLANT-OPERATED SETTING TOOL

BACKGROUND OF THE INVENTION

1. Field of the Invention

The present invention relates to a propellant magazine for a propellant-operated setting tool and including a pocket foil having a plurality of recessed, spaced from each other, pockets for receiving each a propellant and a cover foil unreleasably connected with the pocket foil for closing the pockets; and to a propellant-operated tool with a propellant delivered from such a magazine.

2. Description of the Prior Art

U.S. Pat. No. 5,208,420 discloses a propellant magazine for a propellant-operated setting tool and having a strip-shaped pocket foil with a plurality of spaced from each other pocket in which propellants are received. A strip-shaped cover foil is used for closing separate pockets. The propellants in the separate pockets are ignited with a striking pin of the setting tool displaceable in the setting direction. A propellant is ignited upon the striking pin impinging the cover foil above the propellant.

The displacement of the striking pin into its ignition-ready initial position, which is effected against a biasing force in a direction opposite the setting direction, is very strenuous for the setting tool operator. In addition, the striking pin is subjected to mechanical wear which breaks the airtightness of the striking pin. This adversely affects the ignition process and its effectiveness. The wear of the striking pin requires its replacement from time to time. This causes an undesirable work interruption.

Accordingly, an object of the present invention is to provide a propellant magazine for a setting tool operated with a solid propellant which magazine would insure a fatigue-free operation and which can be economically manufactured.

Another object of the present invention is to provide a propellant magazine which provides for an easy ignition of the solid propellants located in the pockets.

A further object of the present invention is to provide a propellant magazine easily displaceable in the setting tool.

SUMMARY OF THE INVENTION

These and other objects of the present invention, which will become apparent hereinafter, are achieved by providing, in the propellant magazine, an electrically conducting strip associated with each of the pockets for igniting a propellant located in the pocket, and having at least one contact point.

In the inventive propellant magazine, the ignition of the propellant takes place when voltage is applied to the conducting strip. The voltage is conducted either through an electrically conductive region of the propellant, which is located in the pocket, or causes a spark discharge in the conducting strip. The voltage can be produced, e.g., with a piezocrystal located in the setting tool.

In order to insure that the current is supplied outside of the pressure and temperature-susceptible pockets or outside of the rocket-receiving region of the setting tool, advantageously, the contact points of the conducting strip are provided radially outwardly of an axial projection of the pocket.

Each propellant magazine has a plurality of pockets in each of which a propellant is located. The propellants of a propellant magazine all have the same power. However, the power of propellants is changed in accordance with the use requirement. To this end, different propellant magazines are used which differ from each by the power of propellants stored therein.

An appropriate codification between the contact points of a propellant magazine and the electrodes of a setting tool should prevent the use of a propellant magazine with high-power propellants in a setting tool which is not designed for an operation with such propellants. The codification is based on a premise that both the contact points of the conducting strip of the electrodes are arranged outside of the pocket at different locations, e.g., on a circumference of a circle. When a propellant magazine is used in a setting tool which is adapted to the power of the propellants stored in the magazine, the contact points of the conducting strip and the setting tool electrodes are superimposed over each other, so that upon the setting tool being pressed against a constructional component, the electrodes contact the contact points of the conducting strip. If a wrong propellant magazine is inserted in the setting tool, the setting tool electrodes and the contact points of the conducting strip do not overlap each other. The codification permits, e.g., the use of logical terms such as "and" or "or", providing for use of analogs of cryptosystems.

When the logical term "and" is used, the conducting strips have several, connected with each other, contact points, so that the use of a propellant magazine in two different setting tool, which differs from each other by the positions of their electrodes, is possible.

To prevent the voltage applied to one conducting strip from igniting several propellants of a propellant magazine, the pocket foil and/or the cover file are (is) formed of an electrically non-conductive material e.g., plastic material, paper, cardboard.

The conducting strips are provided preferably on the non-conductive foil. The conducting strip is provided on the foil, e.g., by being pressed onto the foil or by being rolled in.

Advantageously, the cover foil is formed of an electrically conductive material, with the conductive strip being separated from the cover foil by an insulation layer. In order to provide for generation of an ignition spark in the region of the propellant between the electroconductive foil and the conducting strip, the first electrode of the setting tool should be brought into contact with the conducting strip and the second electrode of the setting tool should be brought into contact with the cover foil. The electrically conductive foil can be formed, e.g., of aluminum as a cover foil. A combination foil formed of insulated from each other, conductive and non-conductive materials, also can be used.

A spark, which slides over the surface of a propellant, is relatively inefficient, therefore, the propellant is ignited with difficulty. An improved ignition of the propellant is achieved by forming the propellant as a pressed element, e.g., as a pellet provided, in this region adjacent to the cover foil, with electrically conductive particles. As electrically conductive particles, e.g., graphite particles can be used. These particles present a smallest electrical resistance for the spark, so that the spark does not slide along the surface of the propellant through these particles. A spark, which is surrounded by the propellant, transmits to the propellant maximum energy.

Advantageously, the pocket foil or the cover foil serves for receiving of a initiating composition. The initiating composition is secured to the pocket foil or the cover foil by being glued thereto. The gluing of the initiating composition to the cover foil facilitate the production of the propellant magazine as the initiating composition can be easily secured to the cover foil and be dried thereon. Also, the ignition of the propellant by using the initiating composition makes the ignition easy because the initiating composition is located next to the propellant, and the flame produced by the initiating composition is applied directly to the propellant.

A particular good ignition spark can be produced with a conducting strip that is interrupted in the region of an electrically conductive particle or in the region of the initiating composition.

In order to insure a good displacement of the propellant magazine in a setting tool, advantageously, the pocket foil and/or the cover foil is are provided, along a longitudinal extension of the propellant magazine, with a plurality of arranged one after another, recesses which provide for displacement of the propellant magazine. The recesses are formed, e.g., as through-opening extending through the pocket and cover foils, or as side indentations provided on the longitudinal edges of the pocket and cover foils. Both the through-openings and the side indentations are located between respective separate pockets.

A direct contact between the electrodes of the setting tool and the contact points of the conducting strip can be achieved when it is necessary for the electrodes to be pushed through or cut through the cover or the pocket foil. In this case, the conducting strips are completely protected before the propellant magazine is used.

It is also, however possible, to provide the cover foil or the pocket foil with a recess in the region of the electrodes, so that the conducting strip is freely accessible through the cover foil or the pocket foil. In this case, a contact between the electrodes of the setting tool and the contact points of the conducting strip is provided without the need for the electrodes to be pushed through or cut through the cover foil or the pocket foil.

The connection of the cover and pocket foils with each other can be effected, e.g., by gluing them to each other.

In one of the advantageous embodiment according to the present invention, the contact points of the conducting strip are located at the side of the propellant magazine. In this case, the contact points lie bare and can be directly contacted by the setting tool electrodes, which are arranged on opposite sides of the propellant magazine guide of the setting tool, when the contact points are positioned opposite the electrodes (electrical contact elements) during the displacement of the propellant magazine in the setting tool. This is the case when a propellant associated with the conducting strip is displaced in a cartridge chamber of the setting tool, in which position of the propellant, the contact points of the associated conducting strip are located opposite the electrical contact elements of the setting tool.

It is very convenient when the conducting strip is arranged between the pocket foil and the cover foil of a propellant magazine formed, e.g., as a blister.

The present invention relates also to a setting tool for driving fastening elements into a constructional component, with a propellant necessary for effecting a setting process being delivered from a strip-shaped propellant magazine. For improving this setting tool, it is proposed to provide the setting tool with two electrical contact elements on the opposite sides of the magazine guide of the setting tool for contacting the respective contact points of the conducting strip. The contact elements can be formed, e.g., as slide contact spring-biased in the direction of the magazine strip. In this case, the contact of the electrodes or the contact elements with the contact points of the respective conducting strip takes place when an associated with the conducting strip, propellant is located in the cartridge chamber of the setting tool. In this case, piercing of the contact point thickness is not necessary.

The electrodes or the contact elements can so be arranged on the setting tool that between the contact points of the magazine strip and the electrodes an air clearance remains. However, a spark generated by a high voltage source can easily bridge this air clearance with appropriate design of the setting tool and the magazine.

The novel features of the present invention, which are considered as characteristic for the invention, are set forth in the appended claims. The invention itself, however, both as to is construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
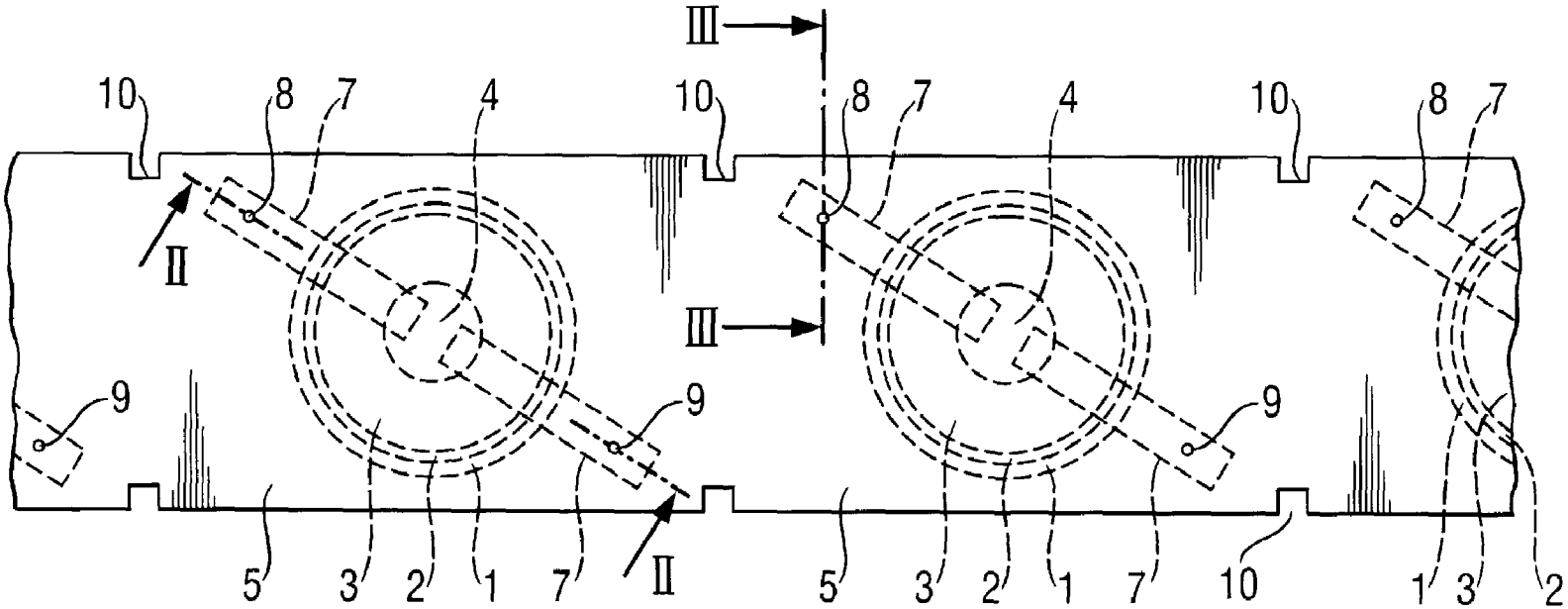
FIG. 1 a plan view of a section of a propellant magazine according to the present invention.
Figure 2:
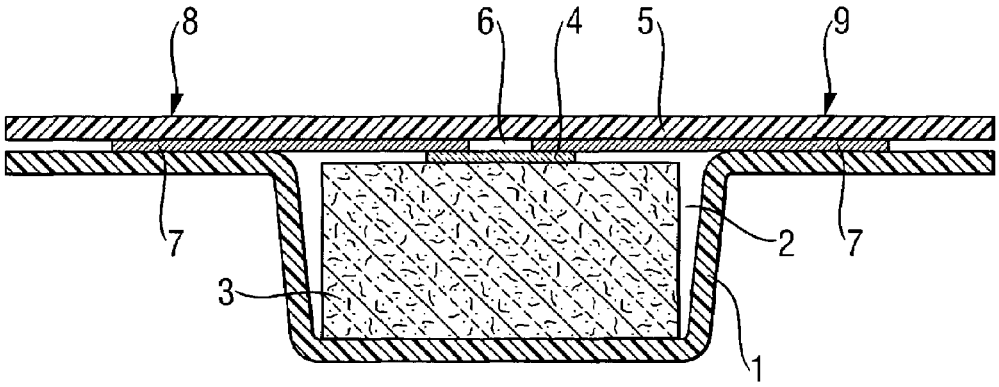
FIG. 2 a cross-sectional view, at an increased scale, of the propellant magazine along line II—II in FIG. 1.
Figure 3:
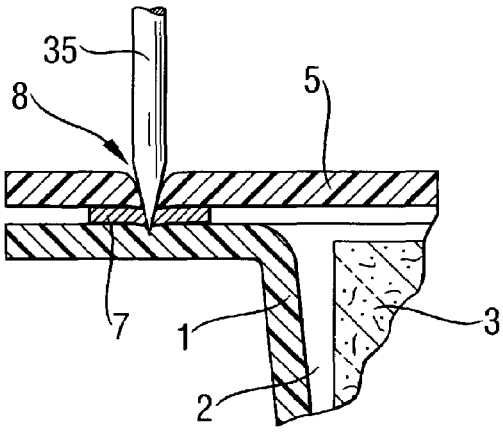
FIG. 3 a cross-sectional view, at an increased scale, of the propellant magazine along line III—III in FIG. 1, together with a conducting strip-piercing electrode.

A propellant magazine according to the present invention, which is shown in FIGS. 1 through 3, has a plurality of spaced from each other pockets 2 for receiving each a propellant 3 and an initiating composition 4 for igniting the propellant 3. The pockets 2 are formed by a pocket foil 1. A cover foil 5, which is unreleasably glued to the pocket foil 2, closes the separate pockets 2. In the region of each pocket 2, between the cover and pocket foils 1, 5, a conducting strip 7 extends. The conducting strip 7 is interrupted in the region of the initiating composition and forms two contact points 8 and 9 which are arranged, in the radial direction outside of the pocket 2. The propellant is formed as a pellet. However, the propellant 3 can be in form of powder filling a pocket 2. The pocket foil 1 and the cover foil 5 are formed each of a strip-shaped, thin-walled foil formed, e.g., of a plastic material that conducts no current. It is also possible to form the pocket foil 1 and the cover foil 5 circular, so that separate pockets 2 are arranged not after one another but rather next to each other. As show in FIG. 1, both the pocket foil 1 and the cover foil 5 are provided, along their longitudinal edges, with a plurality of recesses 10 in form of indentations in which during the displacement of the propellant magazine, a displacing pawl (not shown) of a setting tool (which is likewise not shown) can formlockingly engage. The separate, spaced from each other pockets 2 are arranged between the respective recesses 10.

The recesses 10 can also be formed as through-openings which extend in the central region of the propellant magazine between two pockets 2 through both the pocket foil 1 and the cover foil 5.

The conducting strip 7, which is connected with the initiating composition 4, extends, as it has already been discussed previously, between the pocket foil 1 and the cover foil 5 and is interrupted to provide for a spark discharge in the ignition region 6 of the initiating composition 4 upon application of a voltage to the conducting strip 7. Instead of the interrupted conducting strip 7, it is possible to provide, in the region 6 of the initiating composition 4, a conducting strip having a reduced cross-section where a spark discharge can take place. As it has also been discussed above, the end regions of the conducting strips 7 lie, in the radial direction, outside of respective pockets 2 and have each two contact points 8, 9 connectable with respective electrodes 35. An electrode 35, which extends through the cover foil 5 and the conducting strip 7 is shown in FIG. 3. The electrode 35 forms part of non-shown setting tool and has a sharp tip.

The conducting strip 7 is glued to a side of the cover foil 5 facing the pocket foil 1. It is also possible to press the conducting strip 7 into the cover foil 5 or to roll it into the cover foil 5.

Figure 4:
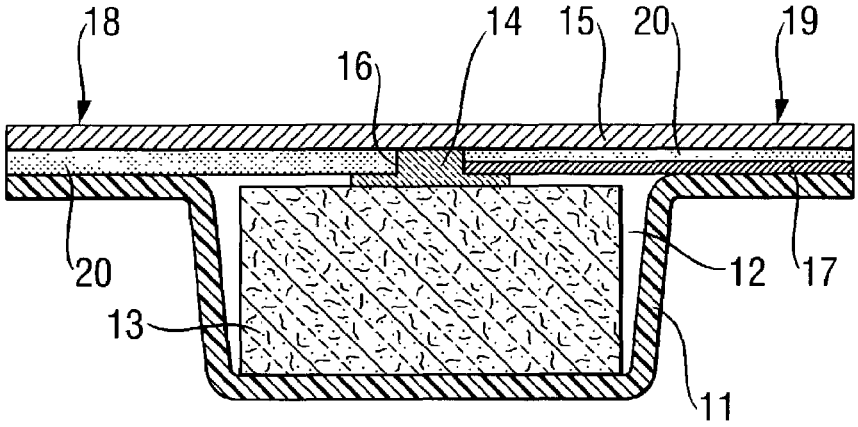
FIG. 4 a cross-sectional view, at an increased scale, of a further embodiment of a propellant magazine according to the present invention.

FIG. 4 shows a propellant magazine in which the cover foil 15 is formed of an electroconductive material, whereas the pocket foil 11 is formed of a nonconductive material. A glue layer 20 extends between the cover foil 15 and the pocket foil 11. Within each pocket 12, a propellant 13 in form of a pellet is located. Between the pellet and the cover foil 15, a initiating composition 14 is provided. Between the glue layer 20 and the pocket foil 11, a conducting strip 17 with two contact points 18, 19 extends. The conducting strip 16 extends up to the initiating composition 14. For igniting the propellant 13, which is located in a pocket 12 of the propellant magazine, two electrodes of a setting tool (not shown) are used to which voltage is applied. Before the voltage is applied, one of the electrodes is pressed against the cover foil. The other electrode is pushed through the cover foil 15 and forms contact with the conducting strip 17. The voltage applied to the two electrodes generates a spark discharge in the ignition region 16.

Figure 5:
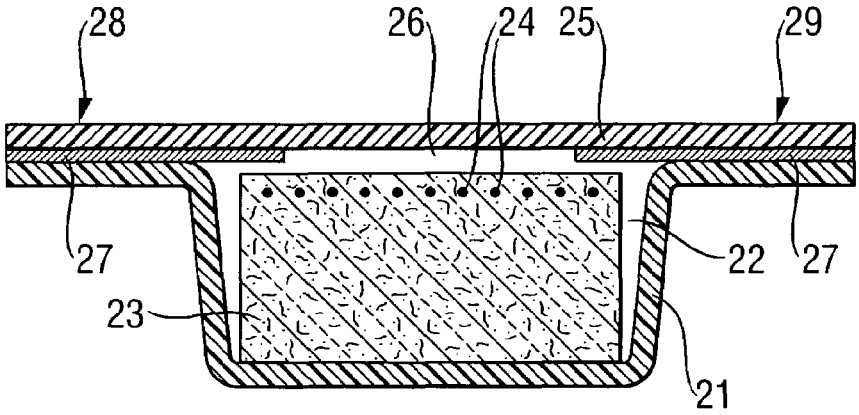
FIG. 5 a cross-sectional view, at an increased scale, of yet another embodiment of a propellant magazine according to the present invention.

A pocket 22 of a further embodiment of a propellant magazine according to the present invention, which is shown in FIG. 5, is designed for receiving a propellant 23 formed as a pellet provided, in the region adjacent to the cover foil 25 with electroconductive particles 24. The cover foil 25 and the pocket foil 21 are formed both of a non-electroconductive material and are glued to each other. Between the cover foil 25 and the pocket foil 21, a conducting strip 27 extends. The conducting strip 27 in interrupted in each of its region associated with a respective electroconductive particle 24 in the propellant pellet. The conducting strip 27 has two contact points 28, 29 through which voltage is applied to the conducting strip 27. The spark discharge takes place in the ignition region 26.

Figure 6:
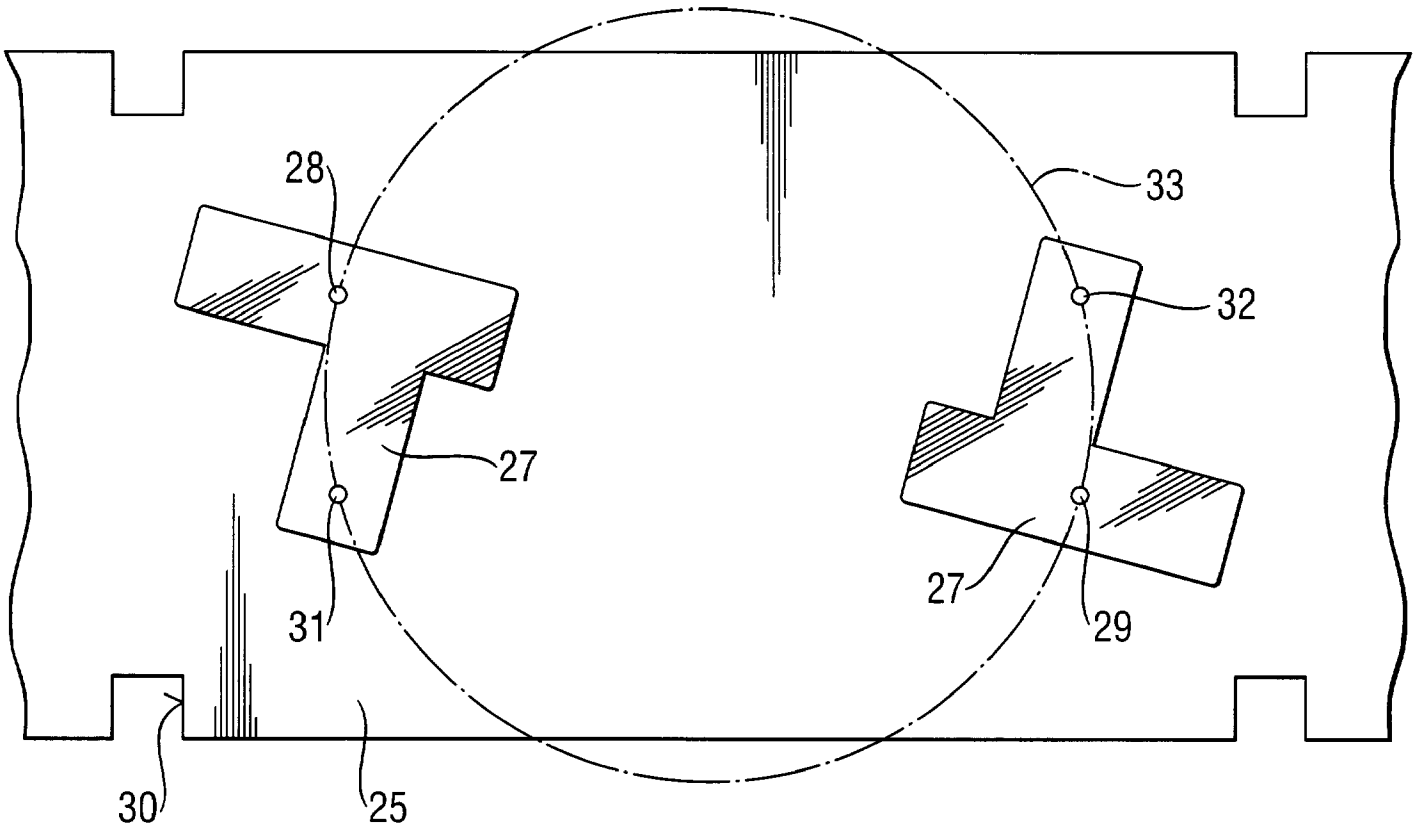
FIG. 6 a plan view of side of the cover foil of the magazine shown in FIG. 5 and adjacent to the pocket foil.

A cover foil 25, which is shown in FIG. 6, has, at its side adjacent to the pocket foil (not shown in FIG. 6), a continuous conducting strip 27. Both sections of the conducting strip 27 have two or more contact points 28, 31; 29, 32 which serve for coding of the propellant magazine. Generally, there are provided two pairs of two located opposite each other contact points 28, 31 and 29, 32. The contact points 28, 29, 31, 32 lie on a common circle 33. For the displacement of the propellant magazine, recesses 30 in form of side indentations provided in the longitudinal edges of the cover foil 25, are used.

Figure 7:
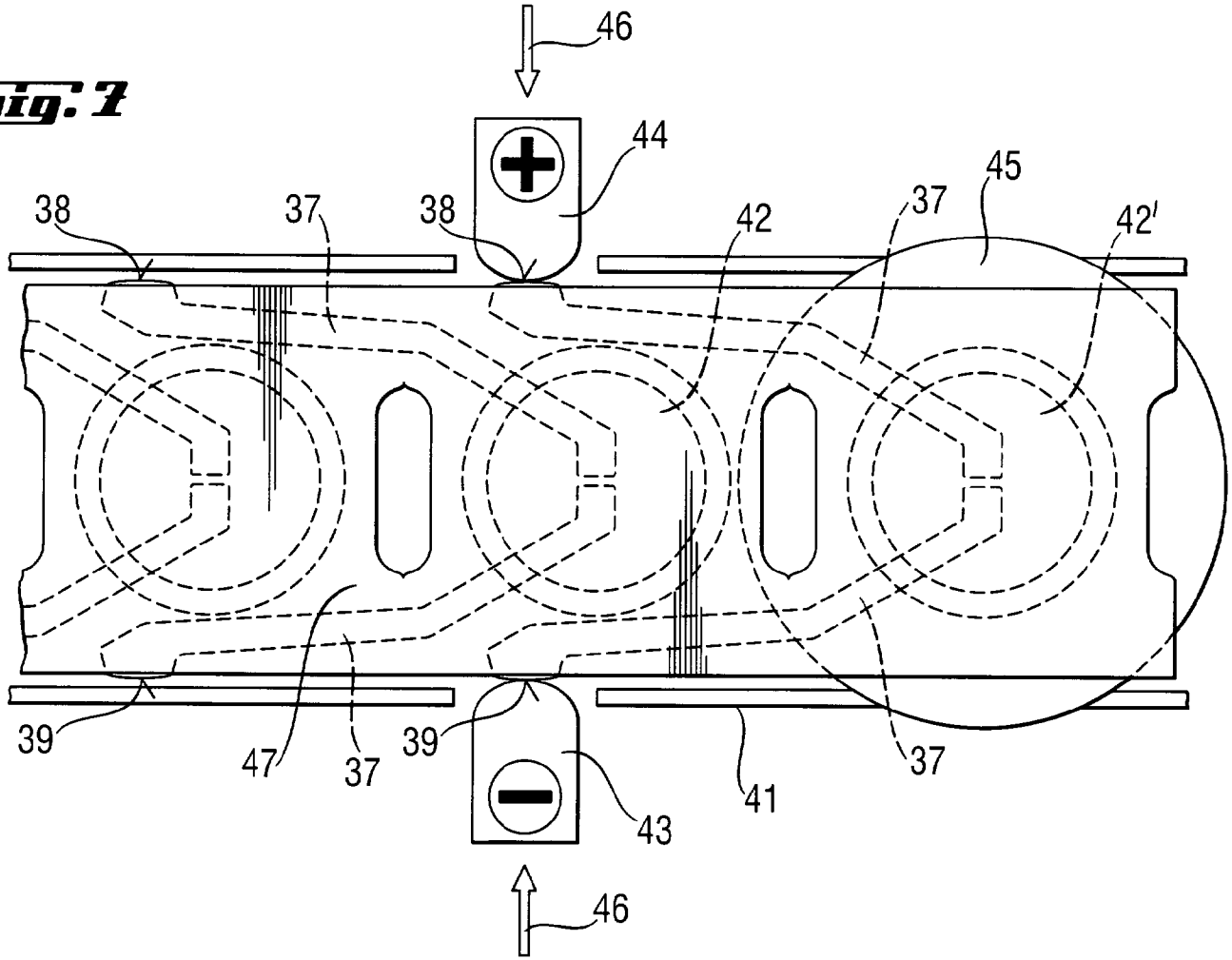
FIG. 7 a schematic view of a section of a propellant magazine according to the present invention arranged in a strip guide of a setting tool.

FIG. 7 show another embodiment of a propellant magazine according to the present invention in form of a magazine strip 47 located in a strip guide 41 of a setting tool (not shown in detail). The magazine strip has a plurality of pockets 42, 42' with a propellant charge, with the pocket 42' being located in a cartridge chamber 45 of the setting tool. The magazine strip 47 has a conducting strip 37 interrupted above the pockets 42, 42'. The free space, which is formed between two halves of the conducting strip 37, serves as a spark track for a to-be-generated ignition spark.

In the embodiment of a propellant magazine shown in FIG. 7, the conducting strip 37 extends on both sides of the magazine strip 47 from a front, in the displacement direction of the magazine strip 47, pocket 42' toward the following pocket 42. The contact points 38, 39 of the conducting strip 37 are provided in the region of the following pocket 42 on opposite sides of the magazine strip 47. The contact points 38, 39 cooperate with electrical contact elements 43, 44 of the setting tool. The electrical contact elements 43, 44 are formed as sliding contacts spring-biased toward the magazine strip 47 in directions shown with arrows 46. The contact elements 43, 44 contact following each other contact points 38, 39 as the magazine strip 47 is advanced. As soon as the setting tool control initiates ignition, the current flows via slide contact elements 43, 44 and contact points 38, 39 to the conducting strip 37, generating an ignition spark at the interruption of the contacting strip 37.

Though the present invention was shown and described with references to the preferred embodiments, such are merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A propellant magazine for a propellant-operated setting tool, the propellant magazine comprising a pocket foil (1, 11, 21) having a plurality of recessed, spaced from each other, pockets (2, 12, 22, 42) for receiving each a propellant (3, 13, 23); a cover foil (5, 15, 25) unreleasably connected with the pocket foil (1, 11, 21) for closing the pockets (2, 12, 22); and a separate electrically conducting strip (7, 17, 27, 37) arranged in an non-electroconductive relationship with respect to the cover foil (5, 15, 25) and associated with each pocket (2, 12, 22, 42) of the plurality of pockets and having at least one contact point (8, 9, 18, 19, 28, 29, 31, 32, 38, 39).

2. A propellant magazine according to claim 1, wherein the conducting strip (2, 12, 22, 42) has two contact points (8, 9; 18, 19; 28, 31, 29, 32; 38, 39) located radially outwardly of an axial projection of the pocket (2, 12, 22, 42).

3. A propellant magazine according to claim 2, wherein the contact points (28, 29, 31, 32) of the conducting strip (27) lie on a circle (33) coaxial with the pocket (22).

4. A propellant magazine according to claim 2, wherein the contact points (28, 29, 31, 32) of the conducting strip (27) lie on a circle (33) coaxial with the pocket (22).

5. A propellant magazine according to claim 4, wherein conducting strip (7, 17, 27, 37) is provided on one of the pocket foil (1, 11, 21) and the cover foils (5, 25).

6. A propellant magazine according to claim 1, wherein the cover foil (25) is formed of an electrically conductive material, and the conducting strip (17) is separated from the cover foil (15) by an insulation layer (20).

7. A propellant magazine according to claim 1, wherein the cover foil (5, 15) serves for receiving initiating means (4, 14).

8. A propellant magazine according to claim 1, wherein each propellant (23) is provided with electrically conductive particles (24).

9. A propellant magazine according to claim 7, wherein the conducting strip (7, 17) is interrupted in a region of the initiating means (4, 14).

10. A propellant magazine according to claim 8, wherein the conducting strip is interrupted in a region of the electrically conductive particles (24).

11. A propellant magazine according to claim 1, wherein at least one of the pocket foil (1, 11, 21) and cover foil (5, 15, 25) is provided along a longitudinal extension of the propellant magazine with a plurality of arranged one after another, recesses (10, 30, 40) for displacement of the propellant magazine.

12. A propellant magazine according to claim 1, wherein the at least one contact point (38, 39) of the conducting strip (37) is provided at a side of the magazine (47).

13. A propellant magazine according to claim 2, wherein the contact points (38, 39) of the conducting strip (37) are arranged between the pocket foil and the cover foil adjacent to ridges of the propellant magazine (47) for contacting respective contact elements (43, 44) of the setting tool.

14. A propellant-operated setting tool for driving fastening elements into a constructional component, with a propellant necessary for effecting a setting process being delivered from a strip-shaped propellant magazine (47) including a pocket foil (1, 11, 21) having a plurality of recessed, spaced from each other, pockets (2, 12, 22, 42) for receiving each a propellant (3, 13, 23); a cover foil (5, 15, 25) unreleasably connected with the pocket foil (1, 11, 21) for closing the pockets (2, 12, 22); and a separate electrically conducting strip arranged in a non-electroconductive relationship with respect to the cover foil (5, 15, 25) and (7, 17, 27, 37) associated with each pocket (2, 12, 22, 42) of the plurality of pockets and having two contact points (38, 39) provided at opposite sides of the magazine (47), the setting tool comprising a guide (41) for guiding the magazine (47); and two electrical contact elements (43, 44) arranged on opposite sides of the guide (41) for contacting respective contact points (38, 39) of the conducting strip (37).

15. A propellant magazine according to claim 4, wherein both the pocket foil (1, 11, 21) and the cover foil (5, 25) are formed of an electrically non-conductive material.

16. A propellant magazine according to claim 1, wherein the separate electrically conducting strip (27) is arranged on a side of the pocket foil (25) adjacent to the pocket foil.

* * * * *